US009455522B1

(12) United States Patent
Ghannam et al.

(10) Patent No.: US 9,455,522 B1
(45) Date of Patent: Sep. 27, 2016

(54) SELF-SEALING ELECTRICAL CONNECTOR

(71) Applicant: Ford Global Technologies, LLC, Dearborn, MI (US)

(72) Inventors: Mahmoud Yousef Ghannam, Canton, MI (US); Swadad A. Carremm, Canton, MI (US); Joel Allen Pittenger, Rochester Hills, MI (US); Aed M. Dudar, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 14/665,267

(22) Filed: Mar. 23, 2015

(51) Int. Cl.
*H01R 13/52* (2006.01)

(52) U.S. Cl.
CPC ..... *H01R 13/5202* (2013.01)

(58) Field of Classification Search
CPC ..... H01R 13/5202; H01R 13/453
USPC ..... 439/139, 141, 143, 144, 145, 271
See application file for complete search history.

(56) References Cited

U.S. PATENT DOCUMENTS 4,577,884 A 3/1986 Harris
5,219,436 A 6/1993 Abbott
5,302,141 A 4/1994 O'Reilly et al.
5,471,740 A * 12/1995 Morse ..... H01R 13/42 29/758
5,564,934 A * 10/1996 Shimotsu ..... G02B 6/3849 439/139
5,667,413 A * 9/1997 Trafton ..... H01R 13/5219 439/271
6,364,673 B1 * 4/2002 Lee ..... H01R 13/4532 174/67
6,595,540 B1 7/2003 MacKarvich
7,673,894 B2 3/2010 Bender
8,277,237 B1 * 10/2012 Cherish ..... H01R 13/60 439/131
8,366,462 B2 * 2/2013 Kuo ..... H01R 24/30 439/131
2008/0129013 A1 6/2008 Weddendorf

FOREIGN PATENT DOCUMENTS

CN 203805645 U 9/2014
DE 20217529 U1 1/2003

* cited by examiner

*Primary Examiner* — Tulsidas C Patel
*Assistant Examiner* — Marcus Harcum
(74) *Attorney, Agent, or Firm* — Frank MacKenzie; Beijin Bieneman PLC

(57) ABSTRACT

A connector assembly includes a housing, a plurality of pins disposed on the housing, a pin chamber disposed on the housing, and a cap disposed on the chamber. The cap has a plurality of holes for receiving the pins. The pins are aligned with the holes when the cap is in an operating position and the pins are offset from the holes when the cap is in a storage position.

23 Claims, 8 Drawing Sheets

SELF-SEALING ELECTRICAL CONNECTOR

BACKGROUND

Traditional electrical connectors used in automotive applications are subject to environmental damage. In the context of automotive trailers, connectors are sometimes dropped on the ground before being securely stowed in, e.g., a vehicle trunk. While on the ground, the connector can become contaminated from water, dirt, salt, sand, etc. Even while connected to the corresponding wire harness of the trailer, the connector can be exposed to dirt, water, and other contaminants. Some connectors include covers to prevent exposure to such elements.

DETAILED DESCRIPTION

Covers do not always adequately protect electrical connectors used in automotive applications. For example, covers sometimes break or they do not seal properly, leaving terminals that would otherwise be protected by the cover susceptible to the elements. Also, a broken cover will not protect the terminals from physical damage such as, e.g., bending. Finally, even if the cover is intact, a person is required to make sure that the cover is properly attached.

An example connector assembly that properly seals the terminals regardless of whether the connector is in use includes a housing, a plurality of pins disposed on the housing, a pin chamber disposed on the housing, and a cap disposed on the chamber. The cap has a plurality of holes for receiving the pins. The pins are aligned with the holes when the cap is in an operating position and the pins are offset from the holes when the cap is in a storage position. In some implementations, a spring disposed on the housing or pin chamber for biasing the cap to the storage position. Other implementations may include incorporating a locking arm into the pin chamber. The locking arm may mate with notches to keep the cap in the operating position, the storage position, or both. Further, engaging the locking arm with the notch can reduce a force applied by the spring on the pins when the cap is in the operating position.

The elements shown may take many different forms and include multiple and/or alternate components and facilities. The example components illustrated are not intended to be limiting. Indeed, additional or alternative components and/or implementations may be used.

Figure 1:
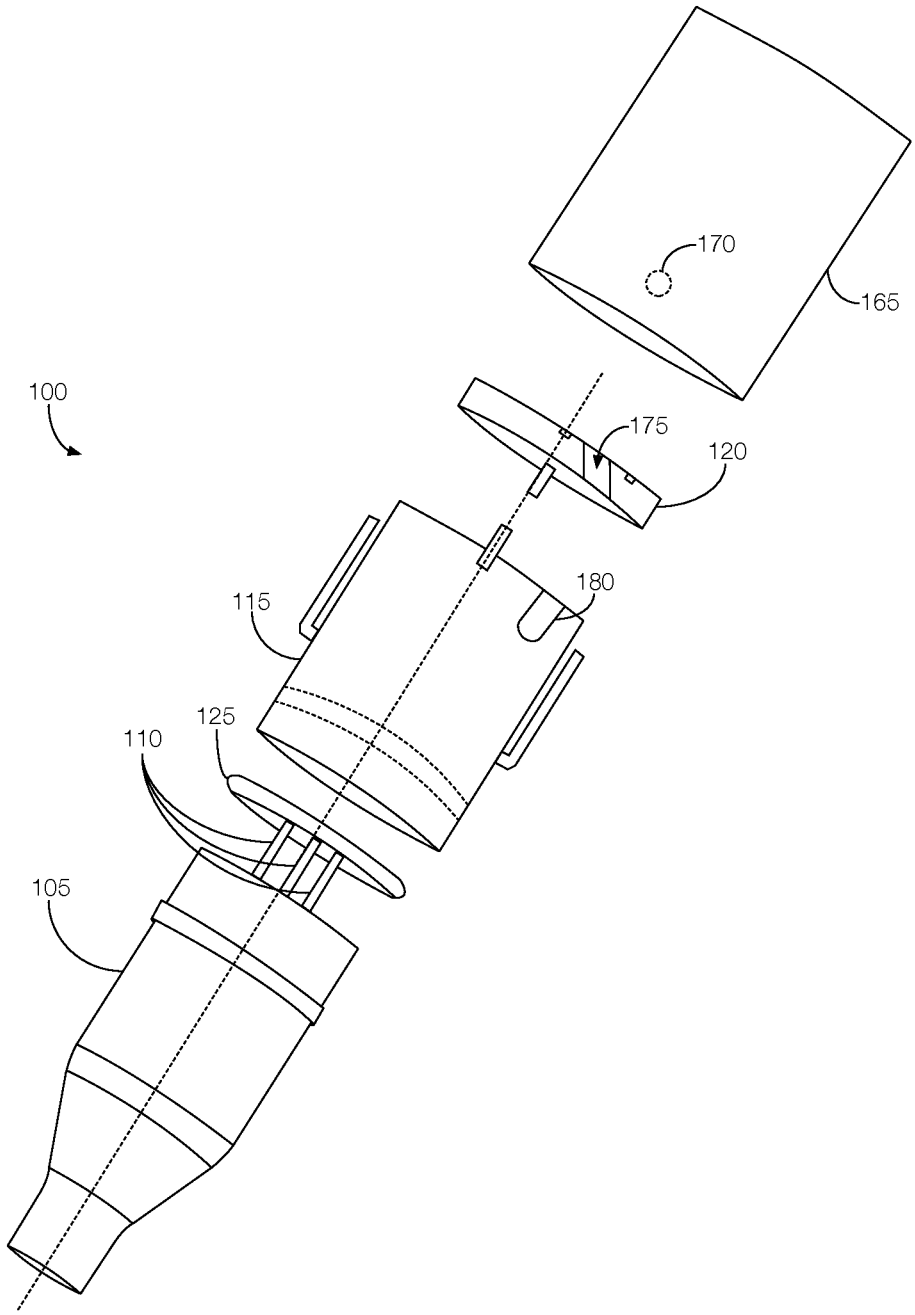
FIG. 1 illustrates an assembly view of an example self-sealing electrical connector.

FIG. 1 illustrates an assembly view of an example self-sealing electrical connector assembly 100. As shown, the connector assembly 100 includes a housing 105, pins 110, a pin chamber 115, a cap 120, and a sealing ring 125.

The housing 105 may be formed from a non-conductive material and sealed to at least partially protect certain components of the connector assembly 100 from exposure to the elements, such as moisture.

The pins 110 may be disposed on the housing 105. The pins 110 may be formed from an electrically conductive material to carry electrical signals from the connector to a corresponding female connector (not shown). Although not shown, the pins 110 may be connected to wires that are contained within the housing 105 and carry electrical signals generated by, e.g., a controller (not shown).

The pin chamber 115 may be disposed on the housing 105 and define an opening for receiving the pins 110. In one possible implementation, the pin chamber 115 may be configured rotational motion, translational motion, or both, relative to the housing 105. That is, as discussed in greater detail below, the rotation and translation of the pin chamber 115 relative to the housing 105 may expose the pins 110 so that the connector may connect to the corresponding female connector.

The cap 120 may be disposed on the pin chamber 115. In one possible implementation, the cap 120 may be fixed to the pin chamber 115 so that both the cap 120 and pin chamber 115 rotate together relative to the housing 105. Alternatively, the cap 120 may rotate independently of the pin chamber 115, as discussed in greater detail below with reference to, e.g., FIGS. 3 and 4. The cap 120 may rotate between an operating position and a storage position. When in the operating position, the pins 110 may stick out of the cap 120 so that the connector assembly 100 can mate with a corresponding female connector. When in the storage position, however, the pins 110 may be contained within the pin chamber 115, which may protect the pins 110 and other components of the connector assembly 100 from exposure to the elements.

In some possible approaches, a mating device 165 may be used to actuate the cap 120 and expose the pins 110. Moreover, the mating device 165 may further compress the springs 135 (see FIG. 2) when moving the cap 120 to the operating position. On the unmating action (e.g., returning the cap 120 to the storage position), the mating device 165 may rotate back to seal the pins 110 within the pin chamber 115. The mating device 165 may include, e.g., a post 170 on an inside surface that is configured to engage a cam slot 175 defined by the cap 120. When the mating device 165 is pushed toward the cap 120, the post 170 and cam slot 175 may cause the cap 120 to rotate. The post 170 may rest in a notch 180 defined by, e.g., the pin housing 115 when in the operating position. To return the cap 120 to the storage position, the post 170 may be released from the notch 180, and the movement of the mating device 165 away from the cap 120 may cause the cap 120 to rotate to the storage position via the movement of the post 170 and cam slot 175.

The sealing ring 125 may be disposed on the pin chamber 115 and the housing 105, and in particular, on an outside surface of the housing 105 and an inside surface of the pin chamber 115 when the connector assembly 100 is fully assembled. The sealing ring 125 fills a gap that would otherwise exist between the pin chamber 115 and the housing 105 to prevent moisture from damaging the pins 110. Another sealing ring 185 (see FIG. 2) may be disposed on the pin housing 115 for sealing a gap between, e.g., the pin housing 115 and the mating device 165.

Figure 2:
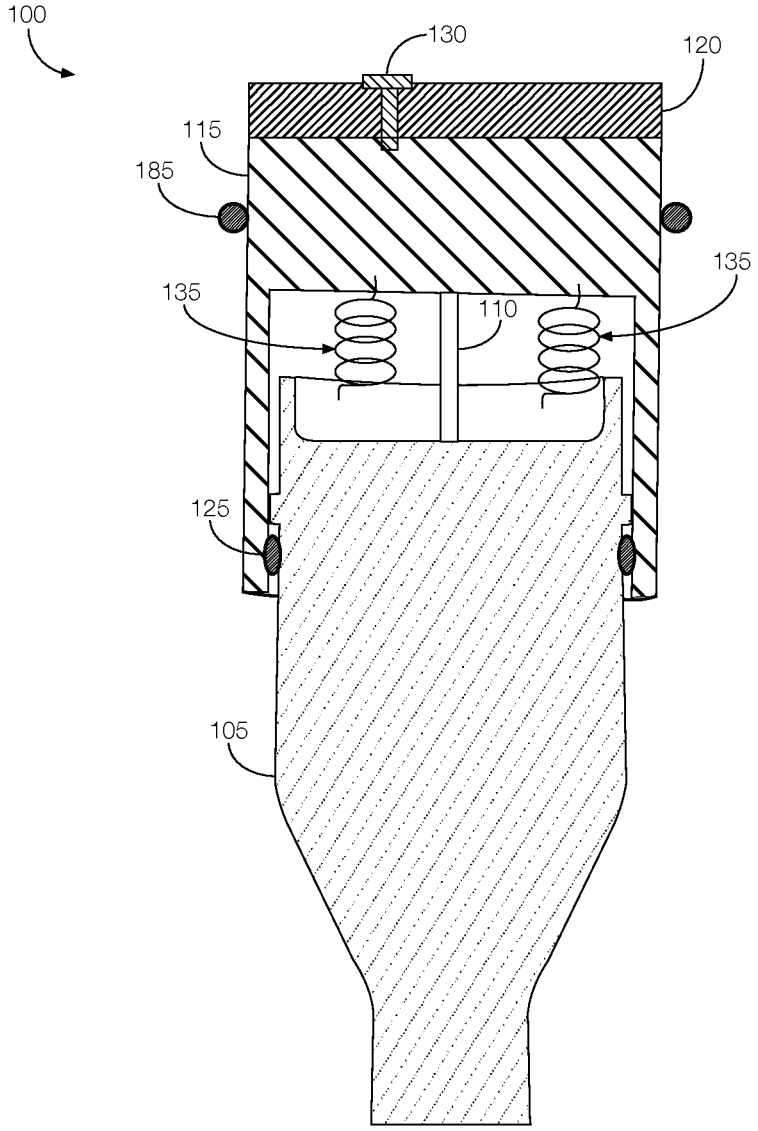
FIG. 2 is a cross-section of the self-sealing electrical connector of FIG. 1 taken along the line A-A shown in FIG. 5.
Figure 5:
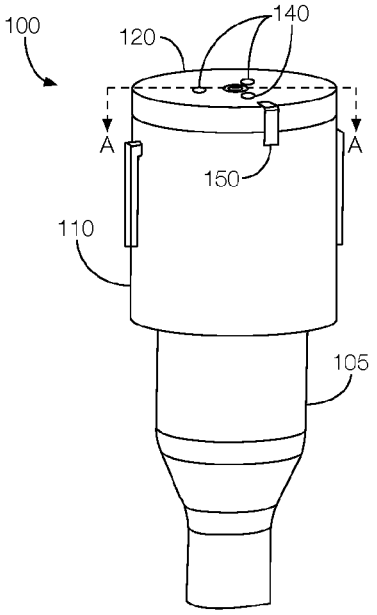
FIG. 5 is a perspective view of the self-sealing electrical connector assembly.

FIG. 2 is a cross-section of the self-sealing electrical connector assembly 100 of FIG. 1 taken along the line A-A (see FIG. 5). As shown, the cap 120 includes a fastener 130 that fixes the cap 120 to the pin chamber 115. The fastener 130 may, in one possible implementation, cause the cap 120 and pin chamber 115 to rotate and translate together relative to the housing 105.

The cross-section of the connector assembly 100 further illustrates springs 135. In one possible implementation, the springs 135 may be disposed on the housing 105. The springs 135 may push the pin chamber 115 and cap 120 away from the housing 105. Thus, the springs 135 may bias the cap 120 toward the storage position. In some instances, such as where the pin chamber 115 and cap 120 are configured to move helically relative to the housing 105, the springs 135 may further bias the pin chamber 115 and cap 120 to rotate helically toward the storage position. Accordingly, when disconnected from a corresponding female connector, the springs 135 may automatically return the cap 120 to the storage position without any user intervention. The user's actuation of the mating device 165, discussed above, to move the cap 120 to the storage position may cause the springs 135 to decompress and rotate the cap 120 back to the storage position. In instances where the mating device 165 is not pressed sufficiently to overcome the bias of the springs 135, the springs 135 may cause the connector 100 to self-reject, meaning that the springs 135 may bias the cap 120 toward the storage position, and reseal. This self-rejection and resealing feature may prevent the cap 120 from staying in the intermediate position, described in greater detail below, since the intermediate position may expose the pins 110 to, e.g., dirt or moisture.

Figure 3:
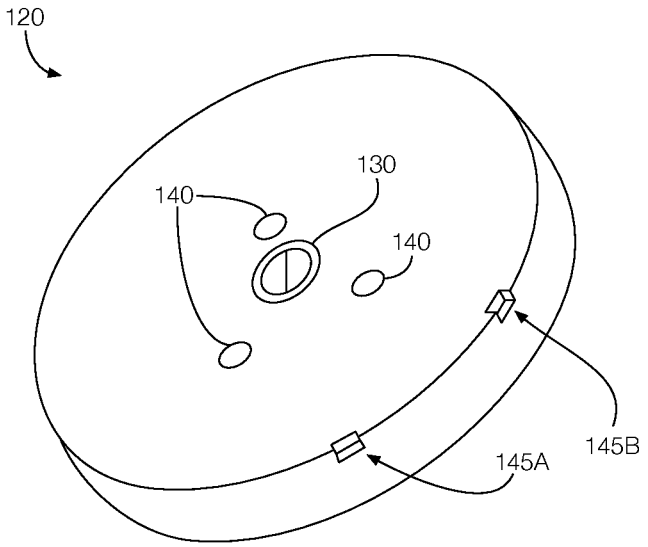
FIG. 3 is a perspective view of a cap that may be used with the self-sealing electrical connector.

Referring now to FIG. 3, the cap 120 that may define holes 140 for receiving the pins 110 when in the operating position. The holes 140 may be offset from the pins 110 when the cap 120 is in the storage position. The holes 140 may align with the pins 110 when the cap 120 is rotated to the operating position. Rotating the cap 120 to the operating position may include overcoming the biasing force of the springs 135 discussed above with reference to FIG. 2.

Figure 4:
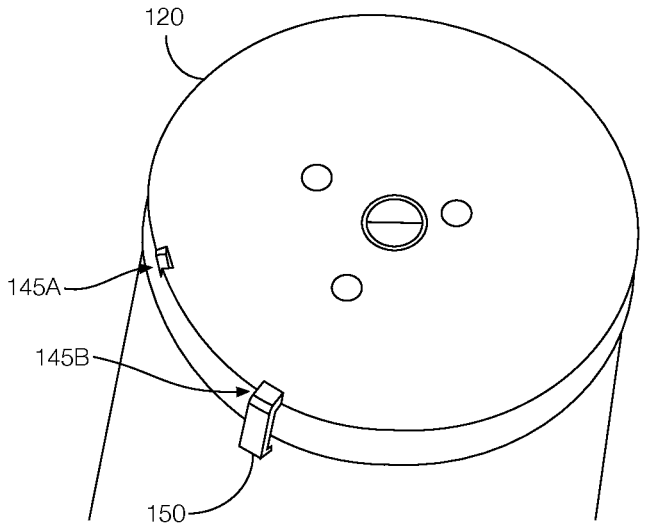
FIG. 4 is a perspective view of a cap and pin chamber having a locking arm.

Further, with reference to FIGS. 3 and 4, the cap 120 may include notches 145. The notches 145 may be configured to receive a locking arm 150 disposed on or integrally formed with the pin chamber 115. A first notch 145A may receive the locking arm 150 when the cap 120 is in the storage position and a second notch 145B may receive the locking arm 150 when the cap 120 is in the operating position.

The locking arm 150 may be manually released by, e.g., pulling part of the locking arm 150 away from the cap 120 so that it clears the notch 145. Once the locking arm 150 has cleared the notch 145, the cap 120 may rotate so long as a force is applied that overcomes the force of a spring, such as a coil spring, that acts on the cap 120 that may cause the cap 120 to rotate toward returning the locking arm 150 to the first notch 145A. When the locking arm 150 is removed from the second notch 145B, the spring that acts on the cap 120 may cause the cap 120 to automatically rotate back to the storage position. The springs 135 discussed above with reference to FIG. 2 may cause the pins 110 to exit the holes 140 prior to the cap 120 rotating back to the storage position.

One or both notches 145 may further relieve certain forces that would otherwise act on the pins 110. For instance, when the pins 110 are extended through the holes 140 when the cap 120 is in the operating position, the bias of certain springs 135 could apply a force to the pins 110. That force, if strong enough, could cause one or more pins 110 to deform. The locking pin engaging the notch 145 may reduce such biasing forces from acting on the pins 110. The post 170 and notch 180 (see FIG. 1) may further reduce such biasing forces from acting on the pins 110.

FIG. 5 is a perspective view of the self-sealing electrical connector assembly 100. As shown, after the cap 120 has been rotated to the operating position, that is, the holes 140 are aligned with the pins 110 and the locking arm 150 has engaged the second notch 145B, the pin chamber 115 and cap 120 may be rotated in a helical direction to expose the pins 110. The helical direction may include moving the pin chamber 115 and cap 120 together in a rotational and translational direction relative to the housing 105. For instance, exposing the pins 110 may include rotating the pin chamber 115 and cap 120 in, e.g., a clockwise or counter-clockwise direction and pushing the housing 105 toward the pin chamber 115 to overcome the bias of the springs 135 in the pin chamber 115. The housing 105 may mechanically attach to the pin chamber 115 in a way that overcomes the spring bias to hold the connector in the operating position. To return the cap 120 to the storage position, the mechanical attachment between the pin chamber 115 and the housing 105 may be released, which may cause the pin chamber 115 and cap 120 to move away from the housing 105 due to the bias of the springs 135. Moreover, the locking arm 150 may be released from the second notch 145B, and the cap 120 rotated, either manually or automatically, so that the locking arm 150 engages the first notch 145A.

Figure 6:
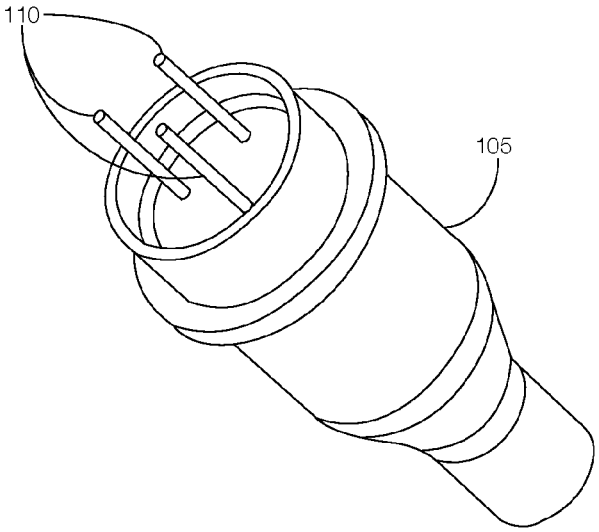
FIG. 6 is a perspective view of the housing and pins of the self-sealing electrical connector assembly.

FIG. 6 is a perspective view of the housing 105 and pins 110 of the connector assembly 100. Although three pins 110 are shown, the connector assembly 100 may include any number of pins 110 disposed on the housing 105.

Figure 7A:
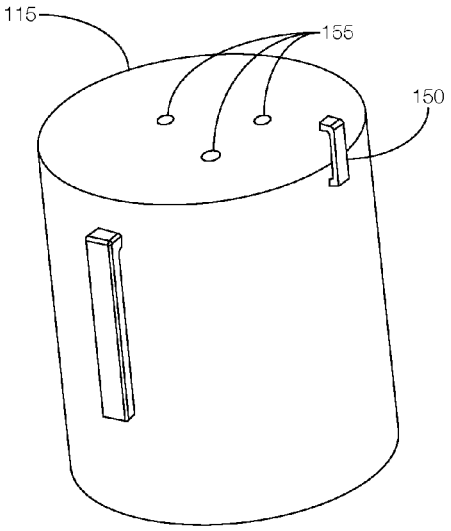
FIG. 7A illustrates an example locking arm that may be located on the pin chamber.
Figure 7B:
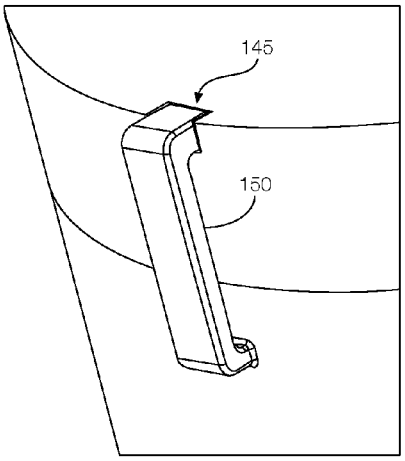
FIG. 7B illustrates the example locking arm engaging a notch in the cap.

FIGS. 7A and 7B illustrate the locking arm 150 that may be located on the pin chamber 115. The locking arm 150 may be a separate component from the pin chamber 115, or alternatively, the locking arm 150 may be integrally formed with the pin chamber 115. The locking arm 150 may extend from the pin chamber 115 toward the cap 120. Moreover, as shown in FIG. 7A, the pin chamber 115 may define openings 155 for receiving the pins 110 when the cap 120 is in the operating position. The number of openings 155 may be directly related to the number of pins 110 disposed on the housing 105. FIG. 7B illustrates the cap 120 disposed on the pin chamber 115 and the locking arm 150 engaging one of the notches 145 in the cap 120.

Figure 8:
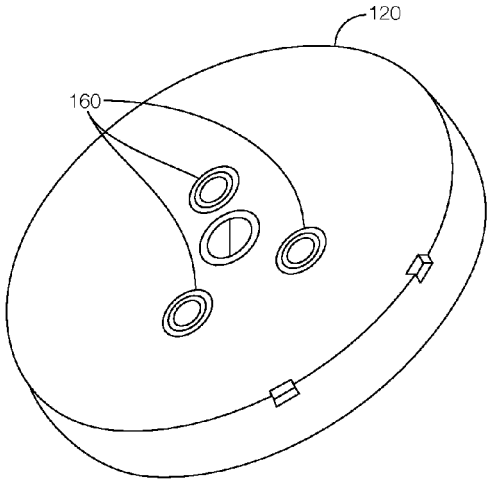
FIG. 8 illustrates an example cap having holes with sealer rings.

As discussed above, the cap 120 may define holes 140 for receiving the pins 110 when in the operating position. Referring now to FIG. 8, the cap 120 may further include sealer rings 160 disposed in each of the holes 140. The sealer rings 160 may seal the holes 140 from, e.g., moisture to protect the pins 110 while the cap 120 is in the storage position. That is, the sealer rings 160 may seal a gap between the cap 120 and the pin chamber 115 that would otherwise be accessible via the holes 140 and openings 155 when the cap 120 is in the storage position. As shown, the number of holes 140, openings 155, and sealer rings 160 may be the same as the number of pins 110 disposed on the housing 105.

Figure 9A:
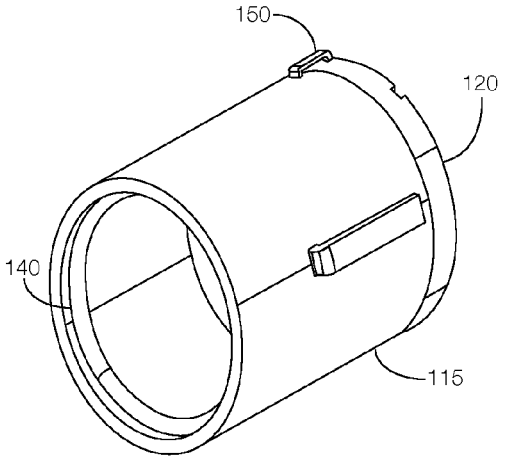
FIG. 9A illustrates a sealer ring disposed on an interior surface of the pin chamber.
Figure 9B:
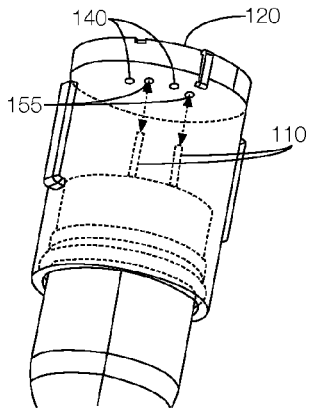
FIG. 9B illustrates the pin chamber and sealer ring disposed on the housing.

FIGS. 9A and 9B illustrate the sealing ring 125 disposed on an interior surface of the pin chamber 115 and between the pin chamber 115 and housing 105, respectively. As discussed above, the sealing ring 125 may prevent moisture from entering a gap that would otherwise exist between the pin chamber 115 and the housing 105. If moisture were to enter that gap, the pins 110 on the housing 105 may become damaged. Therefore, the sealing ring 125 may prevent damage to the pins 110 if, e.g., the connector assembly 100 is exposed to the elements.

Figure 10A:
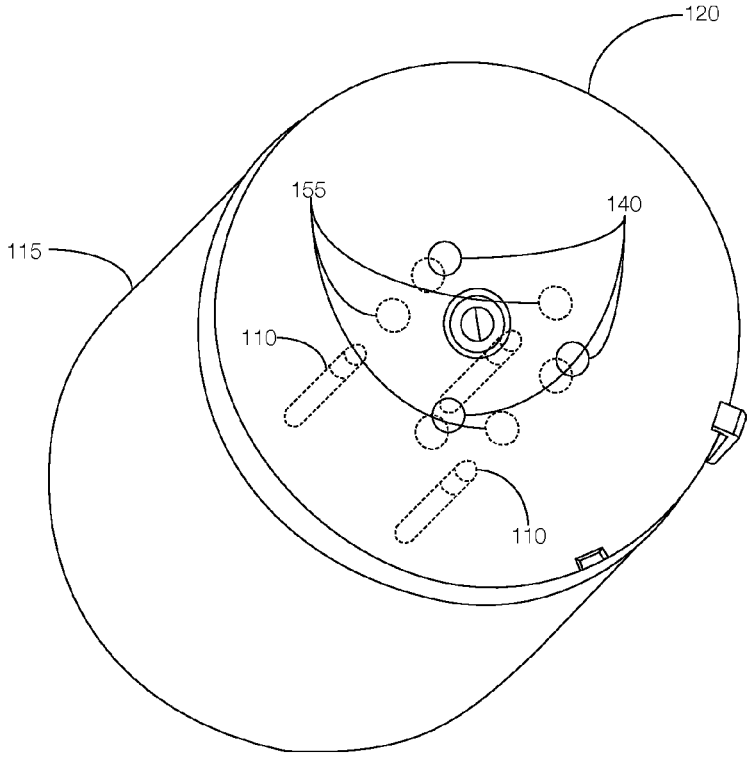
FIG. 10A illustrates the connector in a storage position where the openings and holes are offset from each other and from the pins.
Figure 10B:
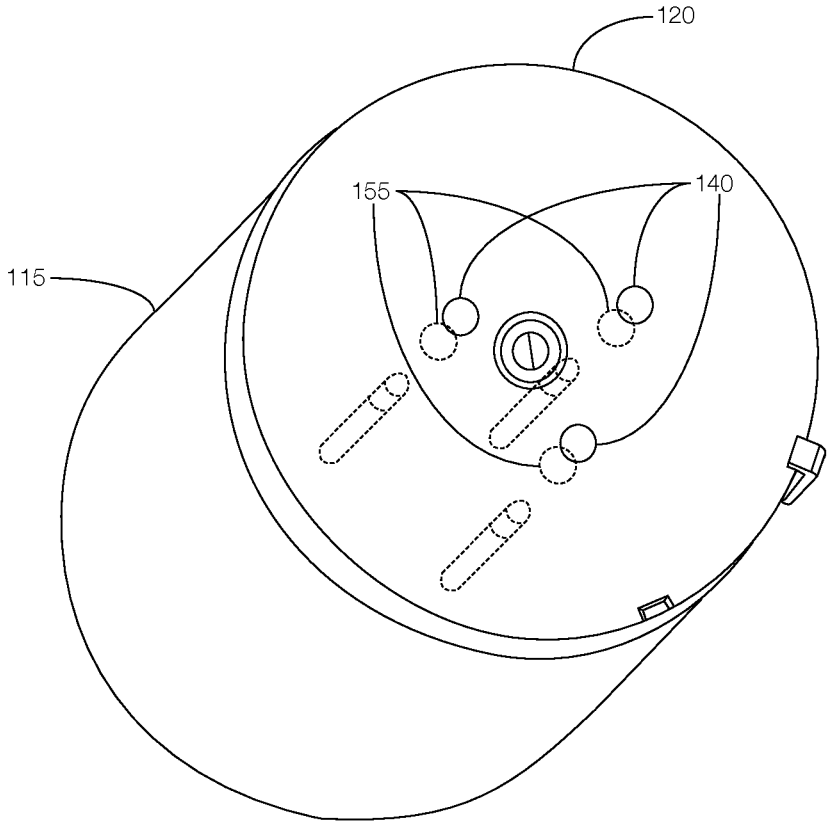
FIG. 10B illustrates the connector is in an intermediate position between the storage position and the operating position where the openings and holes are aligned with the pins.
Figure 10C:
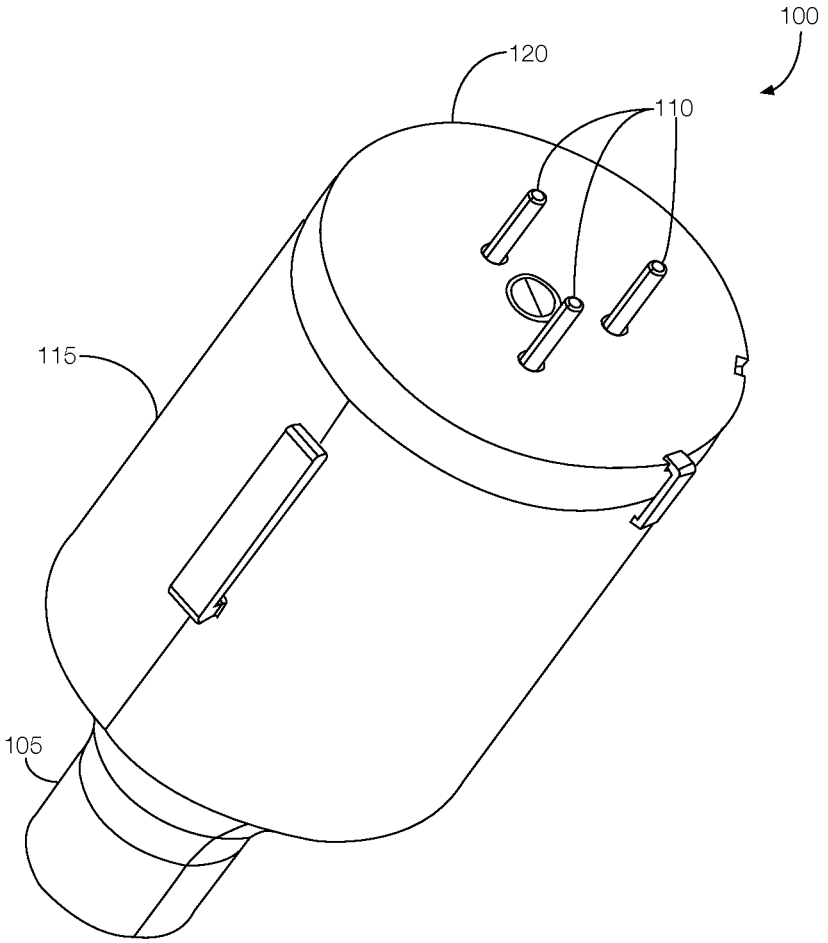
FIG. 10C illustrates the connector in the operating position.

FIG. 10A illustrates the connector assembly 100 in the storage position. When in the storage position, the openings 155 of the pin chamber 115 are offset from the holes 140 in the cap 120. The holes 140 in the cap 120 are represented by two "openings", one on a top surface of the cap 120 and the other on a bottom surface of the cap 120. Moreover, the pins 110 may be offset from the openings 155, the holes 140, or both. When offset, the sealer rings 160 may prevent moisture from entering the holes 140 and openings 155 to prevent damage to the pins 110. FIG. 10B illustrates the connector is in an intermediate position between the storage position and the operating position where the openings 155 and holes 140 are aligned with the pins 110. Note that the openings 155 and holes 140 are aligned yet appear to be separated because of the perspective view and because the holes 140 are shown on a top surface of the cap 120 and the openings 155 are adjacent a bottom surface of the cap 120. Accordingly, the openings 155 in the pin chamber 115 and the holes 140 in the cap 120 may be aligned, and the pins 110 may be aligned with the openings 155 and holes 140. However, when in the intermediate position, the pins 110 may still be contained within the pin chamber 115. FIG. 10C illustrates the connector in the operating position. When in the operating position, the housing 105 may be pushed toward the cap 120, overcoming the bias of the springs 135. The pins 110 may extend through the openings 155 and holes 140 so that the connector assembly 100 can connect to a corresponding female connector.

With regard to the processes, systems, methods, heuristics, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating certain embodiments, and should in no way be construed so as to limit the claims.

Accordingly, it is to be understood that the above description is intended to be illustrative and not restrictive. Many embodiments and applications other than the examples provided would be apparent upon reading the above description. The scope should be determined, not with reference to the above description, but should instead be determined with reference to the appended claims, along with the full scope of equivalents to which such claims are entitled. It is anticipated and intended that future developments will occur in the technologies discussed herein, and that the disclosed systems and methods will be incorporated into such future embodiments. In sum, it should be understood that the application is capable of modification and variation.

All terms used in the claims are intended to be given their ordinary meanings as understood by those knowledgeable in the technologies described herein unless an explicit indication to the contrary is made herein. In particular, use of the singular articles such as "a," "the," "said," etc. should be read to recite one or more of the indicated elements unless a claim recites an explicit limitation to the contrary.

The Abstract is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

The invention claimed is:

1. A connector assembly comprising:
a housing;
a plurality of pins disposed on the housing;
a pin chamber disposed on the housing; and
a cap disposed on the chamber, the cap having a plurality of holes for receiving the pins, wherein the pins are aligned with the holes when the cap is in an operating position and wherein the pins are offset from the holes when the cap is in a storage position,
wherein the cap rotates relative to the pin chamber and wherein the housing rotates relative to the pin chamber and the cap.

2. The connector assembly of claim 1, further comprising a spring configured to bias the cap to the storage position.

3. The connector assembly of claim 2, wherein the spring is biased to push the cap away from the housing.

4. The connector assembly of claim 2, wherein the spring is biased to rotate the cap relative to the housing.

5. The connector assembly of claim 1, wherein the pin chamber has a locking arm and wherein the cap defines a first notch for receiving the locking arm when the cap is in the operating position.

6. The connector assembly of claim 5, wherein the cap defines a second notch for receiving the locking arm when the cap is in the storage position.

7. The connector assembly of claim 5, wherein the cap automatically returns to the storage position when the locking arm is released.

8. The connector assembly of claim 1, wherein moving the cap to the operating position includes rotating the housing and pins in a helical direction relative to the pin chamber and the cap.

9. The connector assembly of claim 1, further comprising a sealing ring disposed on at least one of the housing and the pin chamber.

10. The connector assembly of claim 9, wherein the sealing ring is disposed on an interior surface of the pin chamber.

11. A connector assembly comprising:
a housing;
a plurality of pins disposed on the housing;
a pin chamber disposed on the housing;
a cap disposed on the chamber, the cap having a plurality of holes for receiving the pins, wherein the pins are aligned with the holes when the cap is in an operating position and wherein the pins are offset from the holes when the cap is in a storage position; and a spring disposed on at least one of the housing and the pin chamber for biasing the cap to the storage position, wherein the housing rotates relative to the pin chamber and the cap.

12. The connector assembly of claim 11, wherein the pin chamber has a locking arm and wherein the cap defines a first notch for receiving the locking arm when the cap is in the operating position.

13. The connector assembly of claim 12, wherein the cap defines a second notch for receiving the locking arm when the cap is in the storage position.

14. The connector assembly of claim 12, wherein the cap automatically returns to the storage position when the locking arm is released.

15. The connector assembly of claim 11, wherein moving the cap to the operating position includes rotating the housing and pins in a helical direction relative to the pin chamber and the cap.

16. The connector assembly of claim 11, further comprising a sealing ring disposed on at least one of the housing and the pin chamber.

17. The connector assembly of claim 16, wherein the sealing ring is disposed on an interior surface of the pin chamber.

18. A connector assembly comprising:

a housing;

a plurality of pins disposed on the housing;

a pin chamber disposed on the housing and having a locking arm;

a cap disposed on the chamber, the cap having a plurality of holes for receiving the pins, wherein the pins are aligned with the holes when the cap is in an operating position and wherein the pins are offset from the holes when the cap is in a storage position;

a spring disposed on at least one of the housing and the pin chamber for biasing the cap to the storage position, wherein the cap defines a first notch for receiving the locking arm when the cap is in the operating position and a second notch for receiving the locking arm when the cap is in the storage position, wherein the locking arm engages the notch to reduce a force applied by the spring on the pins when the cap is in the operating position.

19. A connector assembly comprising:

a housing;

a plurality of pins disposed on the housing;

a pin chamber disposed on the housing; and a cap disposed on the chamber, the cap having a plurality of holes for receiving the pins, wherein the pins are aligned with the holes when the cap is in an operating position and wherein the pins are offset from the holes when the cap is in a storage position, wherein the housing rotates relative to the pin chamber and the cap.

20. A connector assembly comprising:

a housing;

a plurality of pins disposed on the housing;

a pin chamber disposed on the housing; and a cap disposed on the chamber, the cap having a plurality of holes for receiving the pins, wherein the pins are aligned with the holes when the cap is in an operating position and wherein the pins are offset from the holes when the cap is in a storage position, wherein moving the cap to the operating position includes rotating the housing and pins in a helical direction relative to the pin chamber and the cap.

21. A connector assembly comprising:

a housing;

a plurality of pins disposed on the housing;

a pin chamber disposed on the housing; and a cap disposed on the chamber, the cap having a plurality of holes for receiving the pins, wherein the pins are aligned with the holes when the cap is in an operating position and wherein the pins are offset from the holes when the cap is in a storage position, wherein the pin chamber has a locking arm and wherein the cap defines a first notch for receiving the locking arm when the cap is in the operating position.

22. The connector assembly of claim 21, wherein the cap defines a second notch for receiving the locking arm when the cap is in the storage position.

23. The connector assembly of claim 21, wherein the cap automatically returns to the storage position when the locking arm is released.

* * * * *